US009695677B2

(12) United States Patent
Moody-Stuart et al.

(10) Patent No.: US 9,695,677 B2
(45) Date of Patent: Jul. 4, 2017

(54) DISAPPEARING PERFORATING GUN SYSTEM

(75) Inventors: Alexander Moody-Stuart, Rio de Janeiro (BR); Michael J. Bertoja, Bellaire, TX (US); Aleksey Barykin, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 711 days.

(21) Appl. No.: 13/594,643

(22) Filed: Aug. 24, 2012

(65) Prior Publication Data

US 2013/0118805 A1 May 16, 2013

Related U.S. Application Data

(60) Provisional application No. 61/530,696, filed on Sep. 2, 2011.

(51) Int. Cl.
*E21B 43/117* (2006.01)
*E21B 43/116* (2006.01)

(52) U.S. Cl.
CPC ..... *E21B 43/117* (2013.01); *E21B 43/116* (2013.01)

(58) Field of Classification Search
CPC ..... E21B 43/117; E21B 43/116; F42B 1/02; F42B 3/08
See application file for complete search history.

(56) References Cited

U.S. PATENT DOCUMENTS

| | | | | |
|---|---|---|---|---|
| 4,253,523 | A | 3/1981 | Ibsen | |
| 5,542,480 | A | 8/1996 | Owen | |
| 6,062,310 | A | 5/2000 | Wesson et al. | |
| 8,794,335 | B2 * | 8/2014 | Fadul et al. | 166/376 |
| 2008/0034951 | A1 * | 2/2008 | Evans | E21B 43/117 89/1.15 |
| 2009/0183916 | A1 | 7/2009 | Pratt et al. | |

OTHER PUBLICATIONS

For the American Heritage Dictionary definition: pattern. (n.d.) American Heritage® Dictionary of the English Language, Fifth Edition. (2011). Retrieved Nov. 20, 2015 from http://www.thefreedictionary.com/pattern.*

AU Application No. 2012300262, Patent Examination Report No. 1, dated Sep. 12, 2016, 3 pgs.

* cited by examiner

*Primary Examiner* — Wei Wang
(74) *Attorney, Agent, or Firm* — Tuesday Kaasch

(57) ABSTRACT

A system and methodology facilitates creation of perforations along a wellbore. The technique utilizes a perforating gun system having cooperating components, such as a carrier, a loading system, and a plurality of shaped charges. The cooperating components are constructed to break down into multiple smaller pieces upon detonation of the plurality of shaped charges. This allows the perforating gun system to effectively disappear within the wellbore such that any remaining small pieces do not interfere with well flow and/or later interventions.

18 Claims, 4 Drawing Sheets

DISAPPEARING PERFORATING GUN SYSTEM

CROSS-REFERENCE TO RELATED APPLICATION

The present document is based on and claims priority to U.S. Provisional Application Ser. No. 61/530,696, filed Sep. 2, 2011, incorporated herein by reference.

BACKGROUND

Perforating guns are used to form openings through a wellbore casing and into the surrounding formation. In some applications, perforating guns also may be used for open-hole perforating. Perforating guns generally include a housing and a support/loading component located within the housing to support charges. A detonating cord is connected between the charges and a detonator or initiator. The detonator is designed to respond to a suitable signal and to then initiate detonation of the detonation cord. A booster is sometimes located between the detonator and the detonation cord. Once the perforating gun is detonated, remaining components are removed from the well; or, the housing, loading component, and debris from the charges remain in the well where they can detrimentally affect flow of the well and/or later interventions or other post-perforation activities.

SUMMARY

In general, the present disclosure provides for a system and method for creating perforations along a wellbore. The technique utilizes a perforating gun system having cooperating components, such as a carrier, a loading system, and a plurality of shaped charges. The cooperating components are constructed to break down into multiple smaller pieces upon detonation of the plurality of shaped charges. This allows the perforating gun system to effectively disappear within the wellbore such that any remaining small pieces do not interfere with, for example, well flow and/or later interventions.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
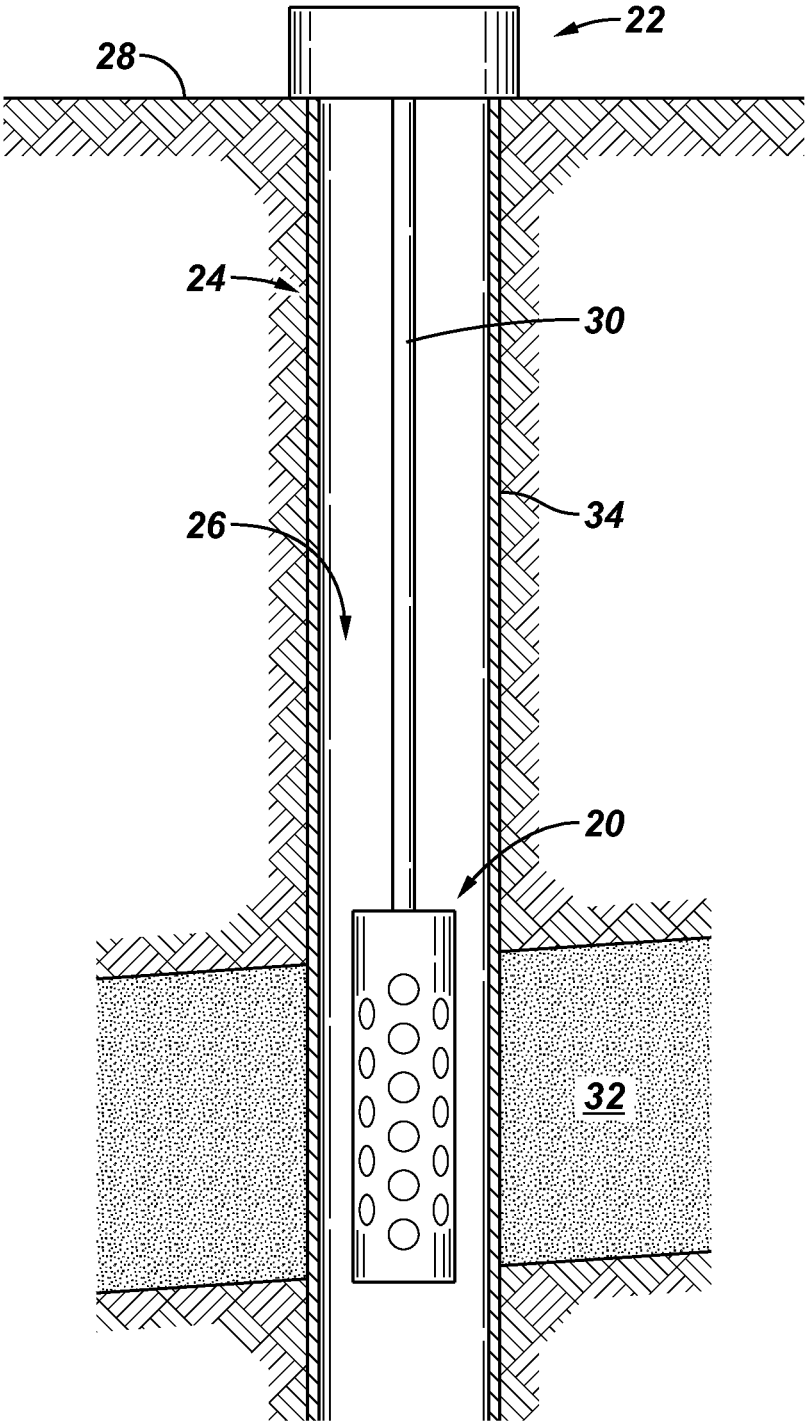
FIG. 1 is a schematic illustration of an example of a well system utilizing a disappearing perforating gun system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology that relate to perforating gun systems. The system and methodology utilize perforating gun systems formed of materials that enable the perforating gun system components to effectively disappear while downhole, e.g. disintegrate into many smaller pieces. By way of example, the perforating gun system components may fracture, degrade, dissolve, burn, or otherwise break down into smaller pieces that do not interfere with well activities, such as production activities and intervention activities.

In a variety of applications, the technique utilizes a perforating gun system having cooperating components, such as a carrier, a support/loading system, and a plurality of shaped charges comprising charge cases, high explosive, liners, and sealing caps. The cooperating components are constructed to break down into multiple smaller pieces upon detonation of the plurality of shaped charges. This break down of perforating gun system components enables the perforating gun system to effectively disappear after formation of the perforations into the surrounding formation.

Various materials and material constructions may be employed to form the perforating gun system components such that, upon firing/detonating the perforating gun, the materials disappear, e.g. degrade, dissolve, or otherwise break into numerous pieces which are not able to interfere or which are washed away via flowing well fluid. By causing the perforating gun system to effectively disappear, the rationale for a deep rat hole below the perforating interval is removed. Consequently, the length of the wellbore can sometimes be shortened and the expense of the drilling process can be reduced. In some applications, the shorter wellbore reduces the possibility of penetrating undesirable high-pressure pockets of fluids, e.g. gas. The disappearance, e.g. disintegration, of the perforating gun system also can reduce the time and expense that would sometimes be incurred with pulling the used perforating gun to the surface. Similarly, by not removing the perforating gun system to the surface, some applications avoid "killing" the well production immediately after perforating. Consequently, certain gas wells and other wells sensitive to kill fluids are better able to support improved production rates.

The perforating gun systems described herein are designed both to effectively disappear, e.g. disintegrate, and to provide adequate structural integrity for performance of the perforating application. In some applications, cooperating components of the perforating gun system are designed to disintegrate and to simultaneously facilitate the disintegration, e.g. breaking, degrading, and/or dissolving, of other cooperating gun components upon detonation of the perforating gun charges. Additionally, various perforating gun system components, or parts of components, may be formed of energetic material which is activated via detonation to burn or otherwise destroy at least some of the gun system components.

By way of example, some embodiments incorporate portions of energetic material into specific components of the perforating gun system. The inclusion of the energetic material in the perforating gun, which is burnt upon detonation of the shaped charges, creates a resulting, effective disappearance of the perforating gun system by breaking components into small particles, burning components, and/or dissolving components. Also, various combinations of inputs may facilitate disintegration of the gun system components, e.g. the addition of heat from burning in combination with reaction products (reaction products that may include acid or solvent) facilitates disintegration of the perforating gun system components.

Examples of energetic materials comprise explosives, pyrotechnic mixtures, propellants, and other materials. In some applications, the energetic materials are designed to create a dual reacting regime having a supersonic regime and a subsonic regime. The supersonic regime may be designed to create a combustion wave preceded by a strong shock wave to bring about a detonation wave that propagates at a high speed (e.g. on the order of several kilometers per second). The speed may be limited by the total thermochemical energy content of the reacting material. The subsonic regime may be designed to create a combustion wave which brings about a deflagration wave which propagates at a slower velocity (e.g. on the order of centimeters per second) and may be limited by heat and mass transfer processes.

In certain applications, the disintegration of perforating gun system components is encouraged by the use of energetic materials suitable for subsonic combustion and those materials may comprise propellants. However, other embodiments may comprise pyrotechnic mixtures, e.g. fuel oxidizer compounds. Examples of pyrotechnic mixtures comprise compositions having solid fuel and solid oxidizer with or without a liquid functional additive, or compositions having solid fuel and solid oxidizer distributed within polymer matrix, e.g. unsaturated polyester resin. The fuel component may be organic or nonorganic, non-explosive fuel (e.g. polymethylmethacrylate, coal powder, graphite), or metallic fuels, such as aluminum or magnesium. By way of example, the solid oxidizer may be ammonium nitrate, ammonium perchlorate, or other suitable oxidizers. An example of a functional additive is a liquid hydrocarbon designed to control charge gas permeability. The perforating gun system charges, e.g. shaped charges, may be cast, pressed of particulate material to any shape or granulate, or otherwise suitably formed. In some embodiments described below, the term "propellant" may be used interchangeably with "energetic materials" to describe the variety of materials capable of burning.

In some applications, propellants are added to improve the break down of the perforating gun system components while facilitating construction of the system with sufficient strength to withstand a variety of deployment applications. The propellant/energetic material facilitates the disintegration and the effective disappearance of the perforating gun system while downhole. For example, addition of the propellant can be used to enable longer gun string lengths and to facilitate operation in high pressure environments while still enabling the subsequent break down of components.

Referring generally to FIG. 1, an embodiment of a perforating gun system deployed in a well is illustrated. By way of example, the perforating gun system may comprise a variety of components and may be employed in many types of applications and environments, including cased wells and open-hole wells. The perforating gun system also may be utilized in vertical wells and deviated wells, e.g. horizontal wells. The perforating gun system also may be utilized with additional components designed to facilitate a specific perforation or other well related application.

In the example of FIG. 1, a perforating gun system 20 is illustrated as part of an overall well system 22 deployed in a well 24 comprising a wellbore 26. In at least some applications, the perforating gun system 20 is deployed downhole into wellbore 26 from a surface location 28 via a suitable conveyance 30, such as a cable, e.g. wireline, or coiled tubing. The perforating gun system 20 is deployed into proximity with a predetermined formation 32 into which perforations are to be formed. The formation 32 generally surrounds wellbore 26 such that the formation 32 may be perforated in a plurality of directions upon detonation of the perforating gun system 20. In some applications, wellbore 26 is formed as an open hole wellbore. However, other applications utilize a cased wellbore in which the perforating gun system 20 is moved down through a surrounding well casing 34. Depending on the specific application, the perforating gun system 20 may be deployed in many types of wells, including vertical wells and horizontal or otherwise deviated wells.

The perforating gun system 20 is designed as a disappearing gun system in the sense that the overall perforating gun system 20 is broken down, e.g. disintegrated, into small pieces which do not detrimentally affect production and/or intervention operations even when there is no large rat hole available. The "disappearing" of the perforating gun system refers to the ability of the system components to break down into multiple, small pieces that can harmlessly collect in a small rat hole or other collection area or that can be carried away by well fluid flow.

Figure 2:
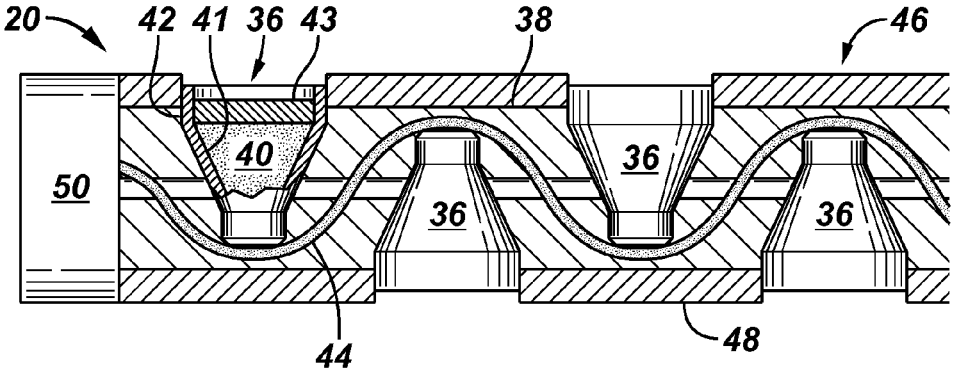
FIG. 2 is a schematic illustration of an example of a perforating gun system having cooperating components which break down into small pieces, according to an embodiment of the disclosure.

Referring generally to FIG. 2, an example of perforating gun system 20 is illustrated. In this example, the perforating gun system 20 comprises a plurality of cooperating components, such as a plurality of shaped charges 36 which may be mounted at various orientations in a loading system 38. By way of example, the shaped charges 36 may be encapsulated shaped charges and each shaped charge 36 may comprise an explosive material 40 disposed in a charge case 42, a liner 41, and a sealing cap 43 to provide a totally enclosed pressure-tight volume. Shape, material, and position of the liners inside the charge cases 42 are designed to direct the energy of the explosive material upon detonation in a desired direction to form the perforations into formation 32. The loading system 38 serves as a support member which holds the shaped charges 36 and may be tubular in shape. A detonation cord 44 may be routed through/along the loading system 38 and may be coupled with the plurality of shaped charges 36 to enable controlled detonation of the shaped charges 36.

The perforating gun system 20 also may comprise another cooperating component in the form of a housing 46. Housing 46 is designed to enclose and protect the shaped charges 36 and the loading system 38. By way of example, housing 46 may be in the form of a carrier tube 48 surrounding the loading system 38. Additionally, a firing head or initiator 50 may be mounted to carrier tube 48 or otherwise suitably mounted to provide controlled detonation of the shaped charges 36. As illustrated, the firing head 50 is coupled with detonation cord 44 and is designed to respond to a suitable signal, such as signal sent from surface 28, to initiate detonation of the shaped charges 36 at a determined time and location.

In some embodiments, the shaped charges 36 are encapsulated to facilitate functioning of the shaped charges under pressure while exposed to wellbore fluids, e.g. gases. The material used to form the liners 41, charge cases 42, and sealing caps 43 may be designed to break into small pieces, e.g. particles, so as not to create sizable or detrimental debris. In some applications, the charge cases 42, sealing caps 43, and/or other components of the shaped charges 36 are formed of a sufficiently strong but breakable material, such as a ceramic material and/or a sintered metal material. Examples of metal materials include materials capable of dissolving, e.g. reacting with formation of water-soluble products, in an acidic or alkaline medium, and such metal materials may include Al-, Zn-, and Mg alloys.

The other cooperating components, such as loading system 38 and housing 46, also may be formed from materials sufficiently strong to enable deployment of the perforating gun system 20 while enabling disintegration into smaller pieces upon detonation of the plurality of shaped charges 36. In some applications, for example, carrier tube 48 is designed as a protective housing able to support and deploy the weight of the overall perforating gun system 20. In certain of these applications, the carrier tube 48 does not have to be a pressure containing device. Additionally, the carrier tube 48 may be designed to allow connections between several perforating guns to facilitate construction of a long gun string. In such applications, the housing 46, e.g. carrier tube 48, may be constructed from a suitable material that disintegrates, such as a dissolving material or easily fractured material. The housing 46 also may be formed with a burning material, e.g. a material with oxidizer, fragmenting materials, or chemically reactive materials that facilitate disintegration of the housing 46 upon detonation of the shaped charges 36. By way of example, a dissolving material may comprise an aluminum alloy which is dissolvable and breaks down in well fluids. Another example of a material for use in housing 46 is a magnesium alloy which is a dissolvable and burnable material in a well fluid environment. The housing material also may comprise an easily fractured material, such as a frangible composite material of metal, polymer, or ceramic matrix. It should be noted the loading system 38 and/or other components of perforating gun system 20 also may be formed from such materials.

In another embodiment, the perforating gun system 20 comprises a semi-flooded gun system which employs a light carrier tube 48 able to withstand tensile loading of a relatively long gun string combined with a pressure containing loading system 38, e.g. loading tube, with shaped charges 36 located inside. The space between the carrier tube 48 and the loading system 38 is flooded in this embodiment, and the loading system provides seats for the charges 36 and exit planes which are capped with corresponding covers. In this type of embodiment, the loading system 38, charges 36 with corresponding covers, and the detonating cord 44 may be assembled into an integrated cylindrical solid body with a smooth cylindrical surface. The loading system 38 may then be placed inside a thin, impervious bag, sealed and centered within the carrier tube 48. In this embodiment and other embodiments described herein, the loading system 38 and/or the housing 46 may be formed from a variety of materials able to disintegrate and to cause the perforating gun system 20 to effectively disappear upon detonation of the shaped charges 36. Examples of such materials which break down due to or upon detonation of the shaped charges include dissolvable materials, e.g. dissolvable aluminum, burnable materials, e.g. PMMA or propellant, or easily fractured materials. Such frangible materials may be used alone or in combination with other materials, such as propellant, integrated into the corresponding gun system component, e.g. carrier tube 48 and/or loading system 38. Other materials which break down into smaller pieces may include materials which are dissolvable in acidic media such as materials based on carbonates and their compound formulas.

Figure 3:
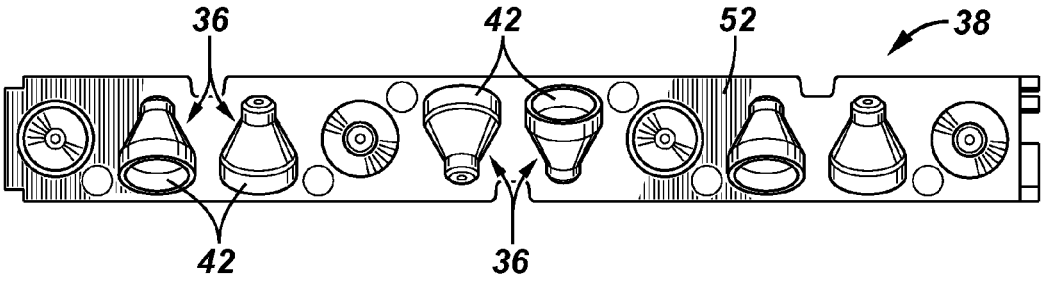
FIG. 3 is an illustration of an example of a loading system supporting shaped charges, according to an embodiment of the disclosure.
Figure 4:
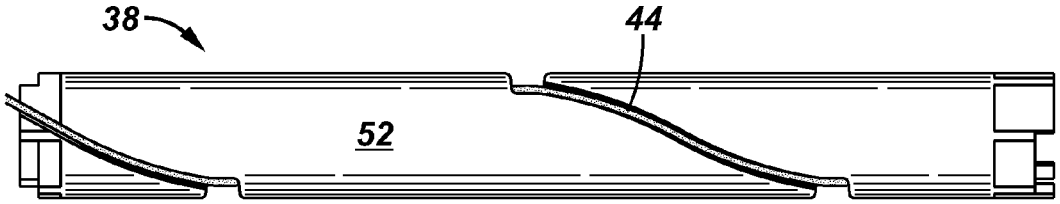
FIG. 4 is an illustration similar to that of FIG. 3 but showing an exterior of the loading system, according to an embodiment of the disclosure.
Figure 5:
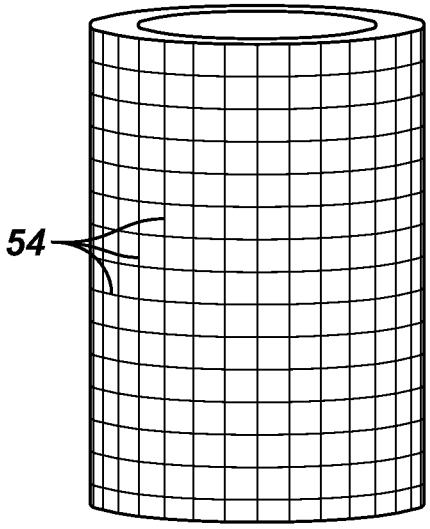
FIG. 5 is a schematic illustration of an example of a perforating gun component having weakened areas, according to an embodiment of the disclosure.
Figure 6:
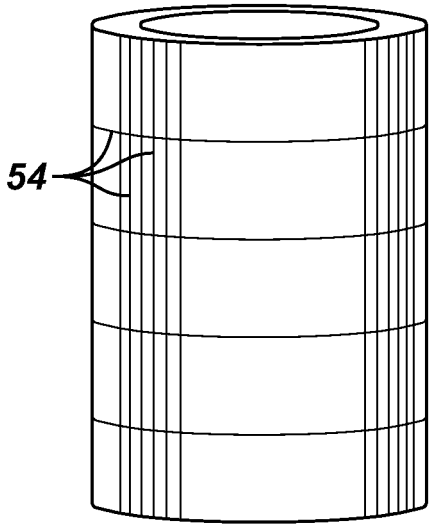
FIG. 6 is a schematic illustration of another example of a perforating gun component having weakened areas, according to an embodiment of the disclosure.
Figure 7:
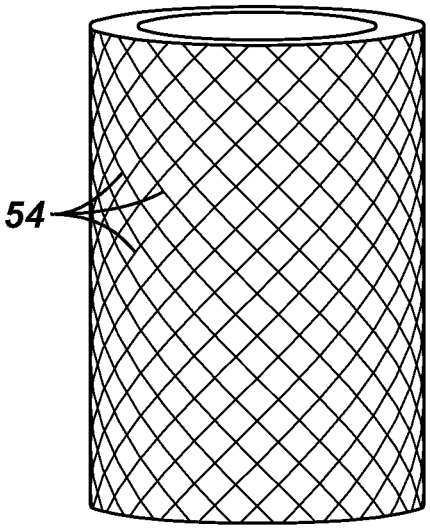
FIG. 7 is a schematic illustration of another example of a perforating gun component having weakened areas, according to an embodiment of the disclosure.
Figure 8:
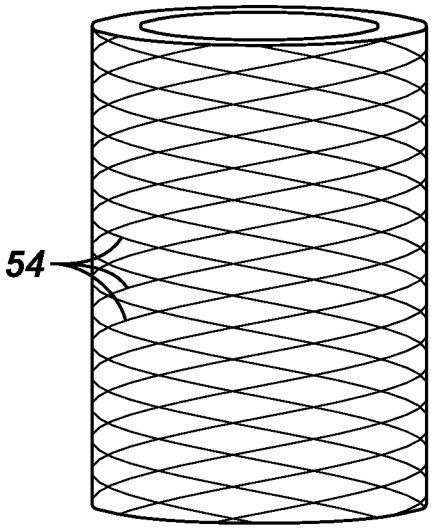
FIG. 8 is a schematic illustration of another example of a perforating gun component having weakened areas, according to an embodiment of the disclosure.

Referring generally to FIGS. 3 and 4, another embodiment is illustrated in which the loading system 38 and the detonating cord 44 are designed to burn up upon detonation of the shaped charges 36. In this example, the loading system 38 supports and positions the shaped charges 36/charge casings 42 and is constructed from or incorporates a cast or formed energetic material 52, e.g. a propellant material. However, the loading system 38 also may be formed from other suitable materials, such as a dissolving polymer, a dissolving aluminum alloy, and/or a dissolvable magnesium alloy. As discussed above, the housing 46 and other components of perforating gun system 20 also may be formed from these materials to facilitate break down of the overall gun carrier system 20 into multiple, smaller pieces. Similarly, the charge cases 42, sealing caps 43, and/or other components of shaped charges 36 also may be formed from material comprising propellant material 52 or other suitable materials which break down into smaller pieces due to the detonation of the high explosive material 40 in shaped charges 36. The charge cases 42 may be arranged in a variety of orientations, such as the sequential angular orientations illustrated in FIG. 3.

Energetic material 52, e.g. propellant, may be integrated or otherwise combined with various cooperating components of the perforating gun system 20. For example, propellant may be located within the housing 46, e.g. along a generally central rod aligned with an axis of the perforating gun system 20 and extending through loading system 38. The energetic/propellant material 52 also may be cast to line the housing 46 four to form the overall carrier tube 48 or portions of carrier tube 48. In some embodiments, propellant material 52 may be integrated with the material forming housing 46 in a manner which facilitates combustion and burning of the housing component or to assist in breaking the housing component into multiple smaller pieces. Upon firing/detonating the shaped charges 36, the propellant material 52 is ignited and thus disintegrates, e.g. burns, the parts formed by the propellant material. The ignition and burning also produces heat and pressure which can be used to break apart other parts of the perforating gun system 20. Furthermore, the ignition and burning gives off produced chemicals, e.g. acids, solvents, and/or catalysts, that can be used to help dissolve or otherwise break down the cooperating components of perforating gun system 20. In some applications, the disintegration of specific components, such as loading system 38, can be used to induce more rapid and complete disintegration of cooperating components, e.g. housing 46.

Referring generally to FIGS. 5-9, various embodiments of the cooperating components of perforating gun system 20 may be formed with weakened areas 54. By way of example, the weakened areas 54 may be formed in housing 46, loading system 38, and/or shaped charge components such as charge cases 42 as machined lines, thinned areas, notched areas, or other types of weakened areas. In an embodiment, lines are machined into the component in a manner which assists breaking the perforating gun system component, e.g. housing 46, into small pieces via detonation of the shaped charges 36. Again, housing 46 (and/or other cooperating components) may have weakened areas 54 formed along its inside and/or outside surfaces to form a cell like pattern or other suitable pattern. The weakened area configuration can be used to control the size of the fragments into which the perforating gun system component shatters upon detonation of the shaped charges. The depth, sharpness, and configuration of the weakened areas, e.g. notches, can be selected according to the intensity of the shock wave impact due to the detonation. As illustrated in FIGS. 5-8, the weakened area pattern may comprise perpendicular crosshatching (see FIG. 5), multiple linear notches (see FIG. 6), diamond shaped patterns (see FIG. 7), and/or helical patterns (see FIG. 8) of weakened areas.

The weakened areas 54 may be formed to enable massive fragmentation due to the shock wave created by detonation. The cooperating gun system components provide sufficient structural integrity until firing of the perforating gun system is initiated. It should be noted that the weakened areas 54 may be used with a variety of structural materials, including many of the fragmenting, dissolvable, burnable, or otherwise disintegrating materials described above. Examples include steel, dissolvable aluminum or magnesium alloys, composite materials, notch sensitive materials such as white or gray iron, or various other suitable materials.

Figure 9:
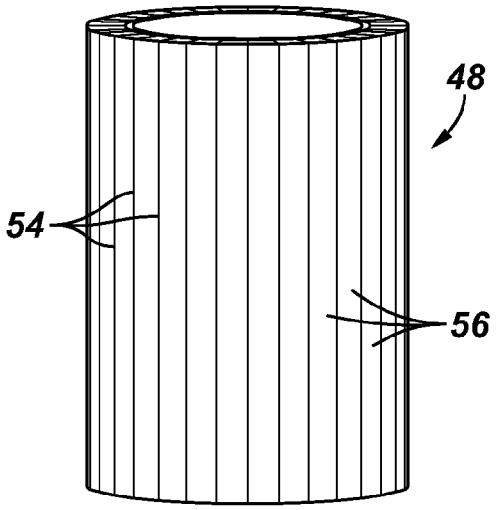
FIG. 9 is a schematic illustration of an example of a perforating gun carrier having weakened areas, according to an embodiment of the disclosure.
Figure 10:
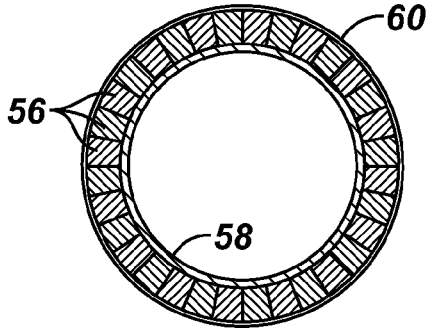
FIG. 10 is a schematic cross-sectional view of a portion of the perforating gun carrier illustrated in FIG. 9, according to an embodiment of the disclosure.

In FIG. 9, another embodiment of carrier tube 48 is illustrated in which the carrier tube 48 is formed of segments 56 cut along a solid cylindrical pipe. The segments may be cut through radially in a longitudinal direction and stuck together to form a cylindrical surface which is stable under external pressure. This type of compound structure is able to withstand external pressure while having the ability to predictably disintegrate under impact from inside, e.g. under impact from detonation of the shaped charges 36. The segments 56 may be joined by several suitable techniques. As illustrated in the partial cross-sectional view of FIG. 10, for example, the segments 56 may be joined and prevented from sliding with respect to each other by adhering or otherwise joining the segments 56 to a thin, internal base pipe 58. The segments 56 also may be surrounded by, and sometimes connected to, an external shield 60 which prevents the segments 56 from separating.

Figure 11:
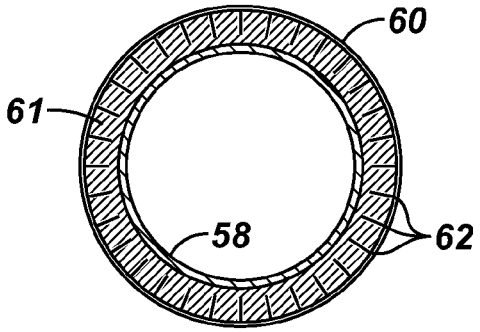
FIG. 11 is a schematic cross-sectional view similar to that illustrated in FIG. 10 but showing another example of weakened areas, according to an embodiment of the disclosure.
Figure 12:
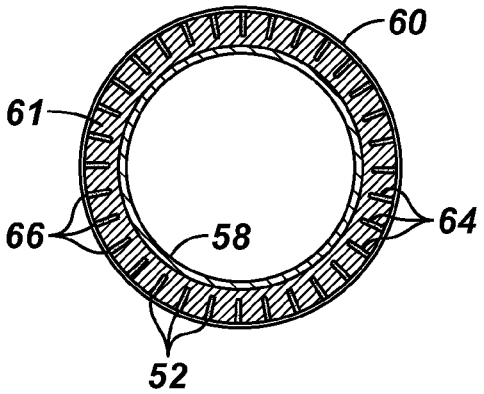
FIG. 12 is a schematic cross-sectional view similar to that illustrated in FIG. 10 but showing another example of weakened areas, according to an embodiment of the disclosure.

In another example, the carrier tube 48 is formed with a source pipe 61 having a series of thin radial cuts 62 which extend partway through the carrier tube 48 in a radial direction, as illustrated in FIG. 11. In this example, internal base pipe 58 and/or shield 60 also may be combined with the source pipe 61. Another embodiment is illustrated in FIG. 12 in which thicker, radial cuts 64 are formed at least partway through source pipe 61 in a generally radial direction. The thicker cuts 64 may be filled with another material, such as a filler material 66 designed to facilitate use and/or disintegration of the carrier tube 48. By way of example, filler material 66 may comprise a structural material, an energetic material (explosive/burnable material 52), a detonating cord material, a linear shaped charge, or another suitable material to promote disintegration of the component into multiple smaller pieces. For example, use of energetic materials 52 (energetic filler material 66) inside the weakened areas 54 can further enhance the cooperating components disintegration upon detonation of the shaped charges 36. It should be noted that the weakened areas 54 can be combined with energetic filler material 52 or other types of materials to enhance disintegration in various perforating gun system components, including the housing 46, loading system 38, and shaped charge components such as charge casings 42.

Figure 13:
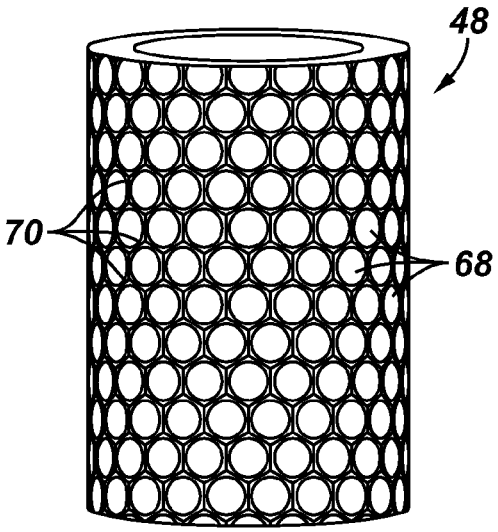
FIG. 13 is a schematic view illustrating another example of weakened areas, according to an embodiment of the disclosure.

Referring generally to FIG. 13, another embodiment is illustrated in which the perforating gun system component comprises small repeating shapes clamped, or otherwise held together, to produce a predictable pattern or tessellation. The tessellated surface of the component enables reliable disintegration into multiple fragments which do not exceed the size of the repeating element. The tessellated surface approach can be used on a variety of the perforating gun system components, although FIG. 13 is used to illustrate the surface of carrier tube 48 for the purpose of explanation.

For example, the carrier tube 48 may comprise periodic or regular tessellations 68 used to form the cylindrical surface of the carrier tube. The tessellations 68 may have a variety of shapes, such as triangles, squares, pentagons, hexagons, or other shapes. The repeating shapes may be made of a variety of suitable structural materials, including dissolvable or otherwise degradable materials. In some embodiments, the tessellations 68 may be made of steel and clamped together by aluminum rivets. After detonation of the shaped charges 36 the rivets are sheared off. However, acid treatments and/or other types of treatments may be used to degrade the rivets to further the disintegration. However, a variety of fastening devices 70 and techniques may be employed, such as adhesives, clamps, wire wraps, and other types of fastening devices. The fastening devices 70 are suitable to maintain the structural integrity of the component during deployment and preparation downhole while enabling separation of the tessellations upon detonation of the shaped charges 36.

In similar embodiments, the component surfaces may employ semi-regular or non-periodic tessellations 68 which utilize two or more shapes to form the surface of the component, e.g. carrier tube 48. In another example, a tessellated pattern is created on the components surface in a manner which follows the arrangement, e.g. spiral curve, of the shaped charges 36 so that a center of the periodic or semi-periodic pattern becomes aligned with an axis of the charge. Compatibility of interfaces between the repeated shapes and the charge phasing allows the convenient arrangement of charge mounting. For example, the shaped charges 36 may be mounted with the aid of a plastic jacket or a direct connection to the tessellated surface of the carrier tube 48. In some applications, the shaped charges 36 may be housed in loading trays or in thin-walled loading tubes. The loading trays or thin-walled loading tubes may be formed from a variety of materials subject to disintegration, including brittle materials, consumable materials, propellants, corrodible alloys, plaster moldings, degradable/dissolvable plastics, and other suitable materials.

The perforating gun system components subject to disintegration may be combined into the perforating gun system. The perforating gun system is then deployed downhole into wellbore 26 to a desired location, such as a location adjacent formation 32. At a desired time, detonation of the shaped charges 36 is initiated via firing head 50. In many of the embodiments described above, the detonation of the shaped charges causes the cooperating perforating gun system components to shatter, burn, degrade, or otherwise disintegrate into multiple, small pieces. The disintegration creates an effective disappearance of the perforating gun system so that the gun system components are not subject to retrieval. A variety of the perforating gun system components may be designed to disintegrate upon detonation of the shaped charges. In many embodiments, the shaped charge components (e.g. charge cases 42), loading system 38, and housing 46 disintegrate simultaneously upon detonation of the shaped charges 36.

Depending on the application and/or environment in which the perforating gun system 20 is employed, the system may have many forms and configurations. The perforating gun system 20 may utilize a variety of cooperating components, including components such as the shaped charges 36, loading system 38, detonation cord 44, housing 46, and firing head 50. These components may be designed with a variety of features which facilitate disintegration of the component upon detonation of the shaped charges. Additionally, individual components or collective components may be designed with various combinations of physical features, energetic material features, chemical features, and/or other features designed to facilitate the predetermined disintegration. For example, the charge cases, the loading system, and the carrier tube may each be formed from fracturable, burnable, dissolvable, chemically reactive, and/or other materials able to disintegrate into smaller pieces. The disintegrating material may comprise metals, polymers, e.g. dissolvable polymers, energetic materials, composites, or other suitable materials. The disintegration may be caused via detonation of the shaped charges or via combination of the detonation and other conditions occurring or induced downhole.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The invention claimed is:

1. A system for creating perforations along a wellbore, comprising: a perforating gun system, comprising:

a plurality of encapsulated shaped charges, each encapsulated shaped charge having a charge case, high explosive, a liner, and a sealing cap;

a carrier to house the plurality of encapsulated shaped charges, said carrier formed of multiple segments of magnesium alloy adhered to an internal base pipe; and a loading system to support the plurality of encapsulated shaped charges; wherein the carrier has a break pattern in its surface and is reduced to smaller pieces along the break pattern via detonation of the plurality of encapsulated shaped charges.

2. The system as recited in claim 1, wherein components of each encapsulated shaped charge are formed to fracture into smaller pieces upon detonation.

3. The system as recited in claim 2, wherein each charge case and each sealing cap comprises a ceramic material breakable due to the detonation.

4. The system as recited in claim 2, wherein each charge case and each sealing cap comprises a sintered metal material breakable due to the detonation.

5. The system as recited in claim 1, wherein the carrier comprises a dissolvable material.

6. The system as recited in claim 1, wherein the carrier comprises a burnable material.

7. The system as recited in claim 1, wherein the carrier comprises a frangible material which breaks into smaller pieces due to the detonation.

8. The system as recited in claim 1, wherein the carrier comprises a chemically reactive material.

9. The system as recited in claim 1, wherein the loading system comprises a burnable material.

10. The system as recited in claim 1, wherein the loading system comprises a dissolvable material.

11. The system as recited in claim 1, wherein the loading system comprises a dissolvable polymer material.

12. The system as recited in claim 1, wherein at least one of the carrier, the loading system, and the plurality of shaped charges comprises an energetic material.

13. A method of perforating, comprising:

providing a perforating gun system with a carrier comprising magnesium alloy, a loading system located within the carrier, and a plurality of shaped charges, said carrier being formed from multiple segments adhered to an internal base pipe;

forming break patterns with weakened areas along the surface of the carrier to control the breakage of the carrier into the smaller pieces upon detonation;

lowering the perforating gun system downhole into a wellbore; and detonating the plurality of shaped charges in a manner which causes the perforating gun system to disintegrate such that the carrier, the loading system, and the shaped charges are each reduced to smaller pieces.

14. The method as recited in claim 13, further comprising forming a charge case and a sealing cap of each shaped charge from a frangible material.

15. The method as recited in claim 13, further comprising forming the carrier as a frangible carrier of dissolvable material.

16. The method as recited in claim 13, further comprising forming at least one of the loading system, the carrier, and the plurality of shaped charges with an integrated energetic material.

17. A system for perforating downhole, comprising:

a perforating gun system formed of a plurality of cooperating components, the perforating gun system having a plurality of shaped charges and a carrier formed of multiple segments adhered to an internal base pipe, each of the plurality of cooperating components comprising magnesium alloy, wherein the carrier has a break pattern in its surface and is reduced to smaller pieces along the break pattern via detonation of the plurality of shaped charges.

18. The system as recited in claim 17, where at least some of the cooperating components comprise propellant material subject to activation by the detonation.

* * * * *